United States Patent [19]

Strickler

[11] Patent Number: 4,643,637

[45] Date of Patent: Feb. 17, 1987

[54] REMOTE OPERATED TURNING GEAR ENGAGER

[75] Inventor: Roger D. Strickler, Mt. Pleasant, Pa.

[73] Assignee: Elliott Turbomachinery Co., Inc., Jeannette, Pa.

[21] Appl. No.: 775,874

[22] Filed: Sep. 13, 1985

[51] Int. Cl.[4] ..... F16H 27/02; F01D 25/34

[52] U.S. Cl. ..... 415/122 R; 415/19; 74/128; 74/142

[58] Field of Search ..... 74/128, 840, 142; 415/1, 19, 122 R; 60/657, 456, 458, 483, 39.091; 416/60, 170 R

[56] References Cited

U.S. PATENT DOCUMENTS

| | | | |
|---|---|---|---|
| 3,791,231 | 2/1974 | Geary | 74/142 |
| 3,859,863 | 1/1975 | Howlett | 74/142 |
| 4,018,094 | 4/1977 | Schmidt | 74/128 |
| 4,090,409 | 5/1978 | Ohleyer | 60/657 X |
| 4,151,760 | 5/1979 | Bernasconi et al. | 415/1 X |
| 4,220,439 | 9/1980 | Burch et al. | 415/19 X |
| 4,267,740 | 5/1981 | Schwarz et al. | 74/128 |

FOREIGN PATENT DOCUMENTS

| | | | |
|---|---|---|---|
| 764745 | 5/1934 | France | 415/19 |
| 59505 | 5/1979 | Japan | 415/19 |
| 75909 | 6/1981 | Japan | 74/128 |
| 1038494 | 8/1983 | U.S.S.R. | 415/19 |

*Primary Examiner*—Everette A. Powell, Jr.
*Attorney, Agent, or Firm*—Robert P. Hayter

[57] ABSTRACT

A remote operated turning gear engager for rotating a turbomachine rotor is disclosed. Pressurized oil is selectively supplied to displace a piston to engage the turning gear with the rotor. Electrical sensing means are utilized to verify that the turning gear is in the appropriate position. Additional control means are provided for discontinuing turning gear operation should insufficient oil be supplied to the bearings. Other circuit means prevent operation of the turning gear should the rotor be rotating and allow for a bypass of this safety feature for positioning the rotor for service requirements.

12 Claims, 2 Drawing Figures

REMOTE OPERATED TURNING GEAR ENGAGER

BACKGROUND OF THE INVENTION

This invention relates to apparatus for automatically engaging of a turning gear to effectively rotate a turbomachine rotor. More specifically, the present invention is directed to apparatus for remotely engaging a turning gear and for providing fail-safe circuitry for assuring appropriate operation.

The necessity of rotating steam turbine rotors at very slow speed following shutdown of the machine is well understood. Any heated rotor which is allowed to stop may become out of round, bow, or develop permanent stresses if not continuously rotated to apply stresses and heating uniformly about the rotor. Conventionally, an electric motor is connected to the turbine shaft through reduction gearing such that the motor may be energized and the gearing engaged to rotate the shaft. The arrangement involving the electric motor and the reduction gearing to provide both motive means and engagement means for placing the gear in contact with the rotor is well known.

At the present time, the general method of engaging turning gears on steam turbines is to manually displace the turning gear to bring it into engagement with a coacting rotor gear. An operator is required to unlatch and pull or push a handle on the turbine and at the same time is required to jog the turning gear until the turning gear engages the coacting rotor gear. Two operators may sometimes be required for this operation.

Turbines are often located in hazardous environments where remote control is desirable. Control from a remote control room would be convenient from an operations perspective also, since it would allow a single individual to effectively engage the turning gear.

Previous turning gear designs permit the operator to engage the turning gear before the rotor is stopped which may result in damage to the rotor and/or failure of the turning gear. The simple mechanical manual engagement provided no preventative limitations which would keep the operator from engaging the turning gear while the rotor was still operating.

Additionally, the turning gear may be utilized to position the rotor when it is desirable to have the rotor in a specific orientation as, for instance, when a specific blade is to be visually inspected. The present turning gear arrangements have the problem that the turning gear does not remain engaged after operation is discontinued. In present designs, the turning gear remains in engagement with the rotor gear as long as the turning gear is being driven to rotate the rotor. Once the turning gear is not driven, the interaction between the gears discontinues and the turning gear returns to its original position out of engagement with the rotor gear. Hence, it is not possible to position the rotor without resetting the turning gear each time the position is to be changed.

The herein described invention concerns a remote control for allowing a single operator in a remote location to simultaneously engage the turning gear and to jog the motor driving the turning gear to allow engagement with the rotor. Additionally, the herein invention provides various interlock means for preventing the turning gear from being engaged to the rotor if the rotor has not stopped. Furthermore, the present invention provides for positive engagement of the turning gear to the rotor such that the turning gear may be utilized to position the rotor for various service requirements without the necessity of repositioning the turning gear each time the rotor position is to be changed.

SUMMARY OF THE INVENTION

It is an object of the present invention to provide a remotely operated turning gear engager for rotating a turbine rotor.

It is another object of the present invention to provide a hydraulically operated piston for displacing a turning gear into engagement with a rotor upon actuation by an operator such that the operator may also jog the turning gear to provide for meshing of the gears as the turning gear is engaged.

It is yet another object of the invention to provide safety means for preventing engagement of the turning gear should the rotor not be stopped.

It is a still further object of the present invention to provide positive engagement of the turning gear with the rotor to allow the turning gear to be utilized for positioning the rotor.

It is a still further object of the present invention to provide an oil pressure safety interlock which acts to prevent the turning gear from rotating the rotor should the oil supply to the rotor bearings be decreased.

It is a yet further object of the present invention to provide a remote control for controlling operation of a turning gear which control is located in a nonhazardous environment.

It is a yet further object of the present invention to provide a safe, economical, and reliable method and apparatus for remotely engaging and operating a turning gear.

Other objects will be apparent from the description to follow and the appended claims.

The above objects are achieved according to the preferred embodiment of the present invention by a turbomachine having a rotor, a turning gear for engaging a portion of the rotor, means for rotating the turning gear, and mounting means for securing the turning gear in a first position in engagement with the rotor and in a second position disengaged from the rotor. An actuator is connected to the mounting means for displacing the turning gear between the first position and the second position. The mode of means for displacing the actuator to the first position wherein the turning gear is engaged with the rotor is connected to the actuator. Additionally, means for sensing that the turning gear is engaged with the rotor and means for initiating operation of the means for rotating the turning gear are provided.

Additionally, disclosed is a remote turning gear engager for use in engaging a turning gear powered by a motor used for rotating a rotor supported on bearings within a turbomachine. This remote turning gear engager includes a piston means for displacing an actuator to engage the turning gear, piping means for supplying pressurized fluid to the piston, valve means for selectively allowing the pressurized fluid to flow to the piston, and means for energizing the motor to rotate the turning gear once the actuator is displaced to engage the turning gear.

BRIEF DESCRIPTION OF THE PREFERRED EMBODIMENT

The apparatus as described herein will refer to a method and apparatus for engaging a turning gear for use with a steam powered turbine. It is understood that such a turning gear may be utilized in other applications such as to rotate the rotor of a power recovery expander, a compressor, or other turbomachine.

Figure 1:
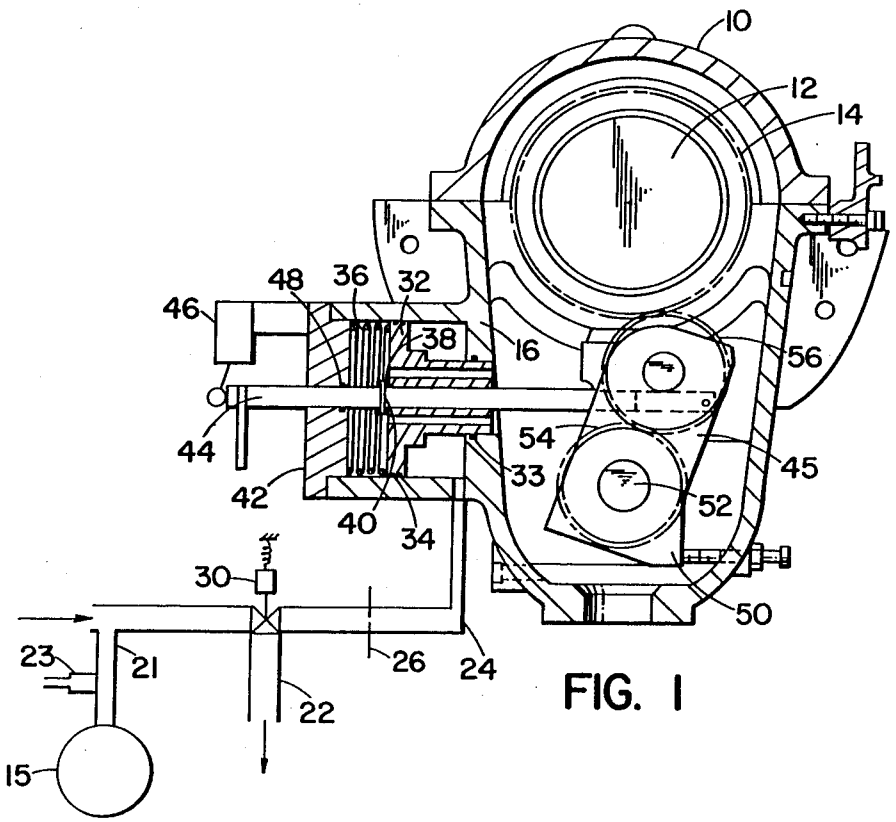
FIG. 1 is a diagrammatic view of a turbine rotor, turning gear, and turning gear engager.

Referring first to FIG. 1 there may be seen a portion of a turbomachine including casing 10 located about the perimeter thereof and rotor 12 mounted within the casing. The turbomachine and its casing are generally of much greater diameter than the bearing casing shown and have been omitted for clarity. Rotor gear 14 is mounted about the circumference of rotor 12 and has, although not shown, gear teeth extending radially outward for meshing with the turning gear.

Turning gear bracket 50 is mounted within the casing and has mounted thereto driving gear 54 which is driven via motor shaft 52 connected to a motor which is not shown. Driving gear 54 is positioned to mesh with turning gear 56 such that the turning gear is driven by the driving gear.

Turning gear handle 44 is connected to link 45 which is attached to the turning gear bracket. The entire turning gear bracket is secured for pivotal movement which may be effected by displacement of a portion of the turning gear bracket caused by displacement of the turning gear handle. The turning gear bracket is shown in a first position with turning gear 56 engaging rotor gear 14 such that the respective teeth of each gear mesh. In this position, the motor acts to drive the driving gear which engages the turning gear which engages the rotor gear to turn the rotor. From the first position, the turning gear handle is moved from left to right as shown in FIG. 1 causing the turning gear bracket to rotate such that the turning gear is moved out of engagement with the rotor gear to a second position.

To effectively displace the turning gear bracket, a hydraulic piston is provided. Piston 32 is mounted within bearing housing 16 and defines a cavity therewith into which pressurized oil is fed through line 24. Piston 32 and the bearing housing 16 define the oil-receiving cavity. O rings 33 and 34 are utilized to seal this cavity. Return spring 36 is mounted to be compressed between cover 42 and the piston when the piston is displaced from right to left as shown. The return spring provides a return force to displace piston 32 to the right. The turning gear and the turning gear handle remain in the engaged position due to the interaction of the turning gear and the rotor gear. The turning gear becomes disengaged upon the turbomachine being powered or the motor being de-energized. In such event, the loss of tooth loading is overcome by gravity and the turning gear falls to the second position.

Oil supply line 20 acts to supply pressurized oil through solenoid valve 30 in the energized state to piston line 24 to operate the piston. In the de-energized state oil flows through drain line 22 to drain oil from piston line 24. Additionally, shown extending from oil supply line 20 is supply line 21 connected to supply oil to rotor bearings 15. Oil pressure switch 23 is mounted to sense the pressure of the oil supply to the bearings. Additionally, orifice 26 is secured within piston line 24 and acts to regulate the rate at which pressurized oil is either supplied to or removed from the piston cavity. This orifice acts to control the rate at which the turning gear bracket is displaced when pressurized oil is forcing the piston to the left to engage the gears.

Switch 46 is shown positioned such that it is contacted by the end of turning gear handle 44 when the turning gear is placed in the first position as shown. Switch 46 is utilized in the control circuit to indicate that the turning gear is in the engaged position. This switch may also be used as a permissive switch to assure the turning gear is in position before starting the motor.

Also shown in FIG. 1 is O ring 48 for sealing the turning gear handle relative to the cover. Sleeve 38 is shown mounted about the circumference of the turning gear handle 44 and secured thereto by pin 40. When piston 32 is displaced by the pressurized oil, it engages sleeve 38 which acting through pin 40 acts to conduct the motion of the piston to the turning gear handle to effect displacement thereof.

Figure 2:
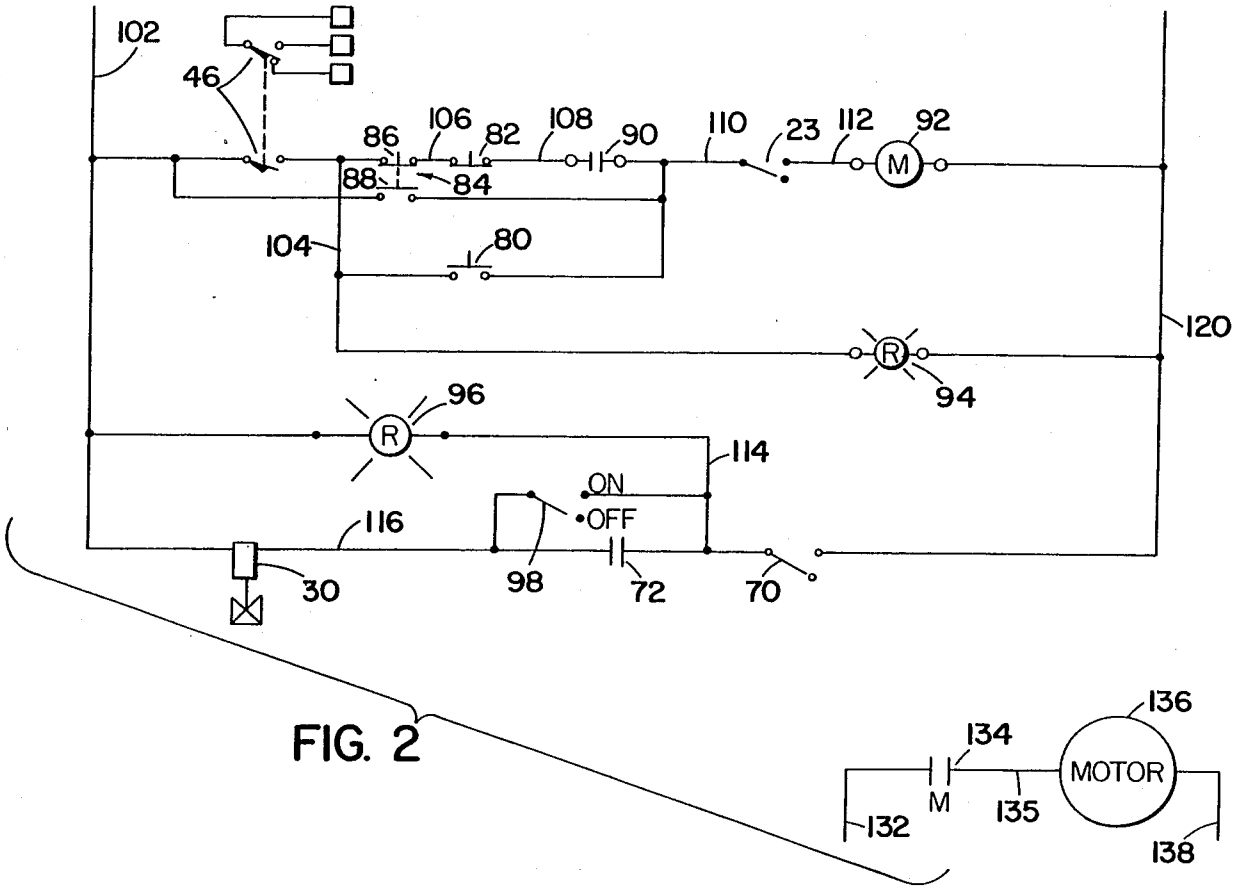
FIG. 2 is an electrical schematic of a control circuit for the turning gear engager and the turning gear motor.

Referring now to FIG. 2 there may be seen the control circuit for operating the turning gear engager. Control power is supplied between wires 102 and 120 for the control circuit. Power flows through wire 102 to switch 46, to contacts 88 of jog switch 84, to start switch 80, to enabled light 96 and to a solenoid 30. Switch 46 has two terminals, one of which is connected between a normally open and a normally closed connection which may be connected to an alarm for indicating that the turning gear is engaged. The other set of contacts of switch 46 are connected to wire 104 which is connected to contact 86 of jog switch 84, to the start switch 80, and to engaged light 94. Contacts 86 of jog switch 84 are connected by wire 106 to stop switch 82 which is connected by wire 108 to interlock relay contacts 90. Interlock relay contacts 90 are connected by wire 110 to contacts 88 of jog switch 84, to start switch 80 and to bearing oil pressure switch 23. Bearing oil pressure switch 23 is connected by wire 112 to interlock relay 92 which is connected to wire 120. Wire 120 is additionally connected to engaged light 94 and to engage switch 70. Wire 116 connects solenoid valve 30 to positioning switch 98 and to zero speed contacts 72. Wire 114 connects enabled light 96 to positioning switch 98, zero speed contacts 72 and to engage switch 70.

Additionally shown on FIG. 2 is a minor portion of the power circuit of the engager. Power is supplied between the wires 132 and 138, through interlock relay contacts 134, through wire 135 and through motor 136. Motor 136 is the motor utilized to power driving gear 54 as shown in FIG. 1.

Operation

Under normal operating conditions, steam is supplied to the turbine to drive a shaft. Under these conditions, the zero speed contacts 72 remain open indicating that the rotor is rotating. In this mode of operation, should the engage switch 70 be closed, the zero speed contacts 72 being open would prevent the three-way solenoid 30 from being engaged and would thereby prevent the engager from meshing the turning gear with the rotor gear.

Once it is decided that the turning gear should be engaged and if the zero speed contacts 72 are closed indicating that operation of the rotor has ceased, then if the engage switch 70 is closed the three-way solenoid will be energized and pressurized oil will be supplied to piston 32. Once the solenoid 30 is energized and the engage switch 70 is closed the enabled light 96 will be energized such that the operator will know the condition of the circuit.

The operator must typically additionally jog motor 136 to jog the turning gear such that the gears mesh as the turning gear is displaced to engage the rotor gear. Jog switch 84 is utilized to effect this operation. When jog switch 84 is pressed, contacts 86 open and contacts 88 close. When contacts 88 close the control circuit connects wire 102 through contacts 88, through wire 110, through bearing oil pressure switch 23 which is normally closed, and through interlock relay 92 to wire 120. Once interlock relay 92 is energized, interlock relay contacts 90 are closed. Once interlock relay contacts 134 are closed power is supplied to motor 136 thereby jogging the motor as desired. Additionally, it is noted that the circuit for allowing the motor to be jogged through contacts 88 bypasses switch 46 such that the turning gear need not be fully engaged with the rotor gear to allow the motor to be jogged.

Once the motor is jogged and the engager energized, the start switch may be utilized. When start switch 80 is closed a circuit is made from wire 102 through switch 46 if the turning gear handle is fully displaced and the turning gear engaged, through wire 104, through start switch 80, through wire 110, through bearing oil pressure switch 23, through wire 112 and through interlock relay 92. Interlock relay 92 then closes contacts 90 and 134. Contact 90 serves as an interlock contact such that when closed provides a circuit from wire 102, through relay contacts 46, through jog switch contacts 86, through stop switch 82, through interlock relay contacts 90 now closed, through wire 110 to bearing oil pressure switch, through wire 112, through interlock relay 92, to wire 120. Contacts 134 when closed energize motor 136. Hence, once the start switch is released, the circuit is made through the now closed interlock relay contacts 90 which maintain interlock relay 92 closed until either the turning gear handle fails to contact switch 46 indicating something has displaced the turning gear or the stop switch is depressed. Additionally, the operation of the motor will be de-energized should the bearing oil pressure switch open, based on insufficient oil being supplied to the rotor bearings.

To stop operation of the turning gear motor, the stop switch is depressed breaking the circuit through interlock relay contacts 90 thereby de-energizing interlock relay 92. To reinititiate operation of the turning gear motor, the process must be recommenced. Engaged light 94 is connected to wire 104 such that the engaged light is energized whenever switch 46 is closed indicating the turning gear is in the first position.

It is to be understood that three-way solenoid valve 30 is energized only when engage switch 70 is manually depressed and only for the time interval during which the switch is depressed. During this interval, pressurized oil is supplied to the piston which is forced to the left acting to displace the turning gear. Once the turning gear is engaged, the mechanical force between the turning gear and the rotor gear acts to keep the two gears engaged.

Positioning switch 98 is provided to bypass zero speed contacts 72. The purpose of positioning switch 98 is to allow the engage switch 70 to be held down and the positioning switch to be closed. In this mode of operation the piston holds the turning gear engaged with the rotor gear and the turning gear motor is energized when appropriate to cause the rotor to be displaced. This combination may typically be utilized when it is desired to place the rotor in a desired rotational position such as for service or visual inspection of the rotor blades. The override switch is normally in the off position such that the zero speed contacts 72 act to prevent operation of the turning gear engager if the rotor is operating.

It is to be understood that zero speed contacts 72 are typically controlled off a speed pick-up for the turbine. Most turbines have some sort of speed control input which senses the rotational speed of the turbine rotor. The zero speed contacts 72 are merely a contact connected to the speed control which are normally open and only closed when the speed control detects no rotational velocity.

The following is a summary of the appropriate operating procedure:

Normal Operation—(Positioning Switch Open)

(1) Close engage switch to cause piston to move turning gear into position to mesh with rotor gear, "enabled" light on;

(2) Push jog button intermittently until "engaged" light is on indicating gears are meshed;

(3) Push "start" button which locks motor on and motor continues to run. We now have no need for engager as gear tooth loading will keep gears meshed. The zero speed contact will open and the engager is disabled;

(4) Open engager switch as a precautionary measure and the "enabled" light goes out. The zero speed contact will already have depressurized the piston allowing the piston to be returned to the right. The turning gear handle and bracket have not moved; and (5) After the recommended start-up time has elapsed, start the turbine with steam. The steam supplies power to the rotor to point where the gear tooth loading between the turning gear and the rotor is lost. At this point gravity and a little tooth loading in the opposite direction cause the turning gear bracket to turn clockwise disengaging the gears and opening switch 46, thereby shutting the motor off automatically without operator action being required.

Service Operation—(Positioning Switch Closed)

(1) Close engage switch to cause piston to move turning gear into position to mesh with rotor gear, "enabled" light on;

(2) Push jog button intermittently until "engaged" light is on indicating gears are meshed;

(3) Use jog button for positioning the rotor. Pressurized oil is supplied to the piston at all times because the "zero speed contact" is overriden or bypassed.

The invention has been described with reference to a particular embodiment. It is to be understood by those skilled in the art that variations and modifications can be effected within the spirit and scope of the invention.

I claim:

1. A turbomachine having a rotor, a turning gear for engaging a portion of the rotor, means for rotating the turning gear and mounting means for securing the turning gear in a first position in engagement with the rotor and a second position disengaged from the rotor which comprises;

an actuator connected to the mounting means for displacing the turning gear between the first position and the second position;

motive means operatively engaged to the actuator for displacing the actuator to the first position wherein the turning gear is engaged with the rotor;

means for sensing that the turning gear is engaged with the rotor; and means for initiating continuous operation of the means for rotating the turning gear when the means for sensing indicates that the turning gear is engaged with the rotor.

2. The apparatus as set forth in claim 1 wherein the motive means for displacing the actuator further comprises:

a fluid-actuated piston connected to displace the actuator to the first position;

a spring for biasing the actuator to the second position; and a piston line for supplying fluid under pressure to the piston.

3. The apparatus as set forth in claim 2 and further comprising:

a source of pressurized fluid;

a solenoid valve positioned between the source of pressurized fluid and the piston line to selectively allow pressurized fluid to enter the piston line; and a flow restrictor mounted in the piston line to control the rate of fluid flow therethrough.

4. The apparatus as set forth in claim 1 wherein the means for sensing that the turning gear is engaged with the rotor is a switch mounted to be engaged by the actuator only when the actuator in is the first position.

5. The apparatus as set forth in claim 1 wherein the means for initiating operation of the means for rotating the turning gear further comprises an electric motor, a jog switch electrically connected to intermittently energize a relay for energizing the motor to jog the turning gear to allow displacement to the first position and a start switch electrically connected to energize the relay to both energize the motor and to engage relay contacts for providing an interlock circuit to maintain the motor energized.

6. The apparatus as set forth in claim 5 and further comprising pressure switch means mounted to serve the pressure of the oil supply to the bearings, said switch means being electrically connected to de-energize the motor should insufficient oil pressure be detected.

7. The apparatus as set forth in claim 1 and further comprising:

a solenoid valve for controlling energization of the motive means;

a zero speed relay contact which closes upon zero rotor speed being detected, said zero speed relay contact being connected in series with the solenoid valve; and an engage switch connected in series with the solenoid valve such that when the engage switch is closed and a zero rotor speed is detected the solenoid valve is energized to engage the turning gear to the rotor.

8. A remote turning gear engager for use in engaging a turning gear powered by a motor, said turning gear being used for rotating a bearing supported rotor of a turbomachine, which comprises:

piston means for displacing an actuator to engage the turning gear;

piping means for supplying pressurized fluid to the piston means;

valve means for selectively allowing pressurized fluid to flow to the piston means through the piping means; and means for energizing the motor to rotate the turning gear once the actuator is displaced to engage the turning gear.

9. The apparatus as set forth in claim 8 and further comprising means for energizing the motor to jog the turning gear to aid in the engagement of the turning gear to the rotor.

10. The apparatus as set forth in claim 9 including means for preventing operation of the valve means if the rotor is rotating to prevent engagement of the turning gear if the rotor is rotating.

11. The apparatus as set forth in claim 10 and further comprising bypass means for allowing the turning gear to be engaged if the rotor is rotating.

12. The apparatus as set forth in claim 8 and further comprising bearing protection means connected to prevent the motor from being energized if there is insufficient oil to lubricate the bearings supporting the rotor.

* * * * *